US007855617B2

(12) United States Patent
Cheung et al.

(10) Patent No.: US 7,855,617 B2
(45) Date of Patent: Dec. 21, 2010

(54) QUADRATURE-DIRECTED QUASI CIRCULATOR

(75) Inventors: Siu K. Cheung, Storrs, CT (US); William H. Weedon, III, Warwick, RI (US)

(73) Assignee: Applied Radar, Inc, North Kingstown, RI (US)

( * ) Notice: Subject to any disclaimer, the term of this patent is extended or adjusted under 35 U.S.C. 154(b) by 53 days.

(21) Appl. No.: 12/467,386

(22) Filed: May 18, 2009

(65) Prior Publication Data

US 2010/0289598 A1 Nov. 18, 2010

(51) Int. Cl.
*H01P 1/213* (2006.01)

(52) U.S. Cl. ..... 333/109; 333/117; 333/136

(58) Field of Classification Search ..... 333/109, 333/110, 117, 124, 125, 126, 129, 132, 134, 333/136, 1.1, 24.2
See application file for complete search history.

(56) References Cited

U.S. PATENT DOCUMENTS 7,369,811 B2 * 5/2008 Bellantoni ..... 455/41.2
2010/0069011 A1 * 3/2010 Carrick et al. ..... 455/63.1
2010/0102899 A1 * 4/2010 Engel ..... 333/117

* cited by examiner

*Primary Examiner*—Stephen E Jones
(74) *Attorney, Agent, or Firm*—Maurice M. Lynch

(57) ABSTRACT

A circulator capable of simultaneous transmit and receive operations, high frequency, high isolation and noise figure suppression comprising: an antenna port; a transmission port; a receiving port; three quadrature hybrids, two directional couplers; wherein transmit signal entering the transmit port are split into quadrature components and coupled separately and directionally by the two directional couplers to the antenna port where the coupled quadrature components of the transmit signal are recombined in phase, while the transmit leakage to the receive port are recombined destructively in phase; said arrangement simultaneously allows the receive signal entering the antenna port to be split into quadrature components by the antenna quadrature hybrid and transmitted through the directional couplers separately and entering the receive quadrature hybrid where the quadrature components of the receive signal are recombined in phase at the receive port; said arrangement reduces the insertion loss from the antenna port to the receive port.

6 Claims, 10 Drawing Sheets

QUADRATURE-DIRECTED QUASI CIRCULATOR

FEDERALLY SPONSORED RESEARCH

This invention was made with Government support under W31P4Q-07-C-0006 awarded by Defense Advanced Research Projects Agency. The Government has certain rights in the invention.

CROSS-REFERENCE TO RELATED APPLICATIONS

Radar systems.

FIELD OF INVENTION

The invention related to methods of constructing active quasi-circulators using phase cancellation/combination and coupling directivity techniques to enhance isolation, suppress NF, reduce insertion loss for broadband simultaneous transmit and receive operations in radar and communication systems.

BACKGROUND INFORMATION

The development of broadband active circulators with high-isolation, low insertion and noise figure suppression for simultaneous transmit and receive (STAR) operations would enable radar multifunctional and multi-tasking functionalities for radar systems. The commercial applications are to promote the development of innovative broadband products and services with simultaneous transmit and receive capabilities for next-wave of multi-tasking industrial products in the areas of ultra-high-speed wireless data communications and broadband internet access. Moreover, these STAR features of the active circulator allow easy subassembly of MMIC integrations with reduction of circuit size and reuse of circuitry redundancy which result in cost savings from system architect.

SUMMARY OF INVENTION

It is an object of this invention to enable a device to simultaneously transmit and receive (STAR) signals.

It is a further object of this invention to enable a circulating device to transmit data signals with enhanced broadband high isolation.

It is a further object of this invention to enable a circulating device to receive said signals with further improvement of insertion loss and enhancement of noise figure suppression at the receive port.

This invention is the realization that all these objects can be met with a quadrature-directive quasi-circulator (QDQC) comprising transmit, receive and antenna ports, quadrature hybrids, directional couplers and active components to achieve the said objects.

This invention features a non-reciprocal quasi-active circulator, which consists of quadrature hybrids, directional couplers and active components for enhanced high isolation, low insertion loss, noise figure (NF) suppression for broadband simultaneous transmit and receive operations.

The invention is a three port device in which the antenna port is placed between a transmit port and a receive port. The circulator has input signal from the transmit port circulated to the antenna port and receive signal from the antenna port to the receive port. It is a quasi-circulator that the reverse transmission from the receive port to the transmit port is isolated.

This invention is a 3-port quasi active circulator that uses phase cancellation/combination and coupling directivity techniques for enhanced high isolation, low insertion loss, noise figure (NF) suppression for broadband simultaneous transmit and receive operations. In particular, the device consists of quadrature hybrids, directional couplers and active components such as power amplifiers and low noise amplifiers to form the so-call quadrature-directive quasi circulator (QDQC). The QDQC has input signal from the transmit port directively coupled to the antenna port and receive signal from the antenna port circulated to the receive port, simultaneously. Both the quadrature hybrids and directional couplers can be implemented by active or/and passive components.

DESCRIPTION OF THE PREFERRED EMBODIMENT

Figure 1:
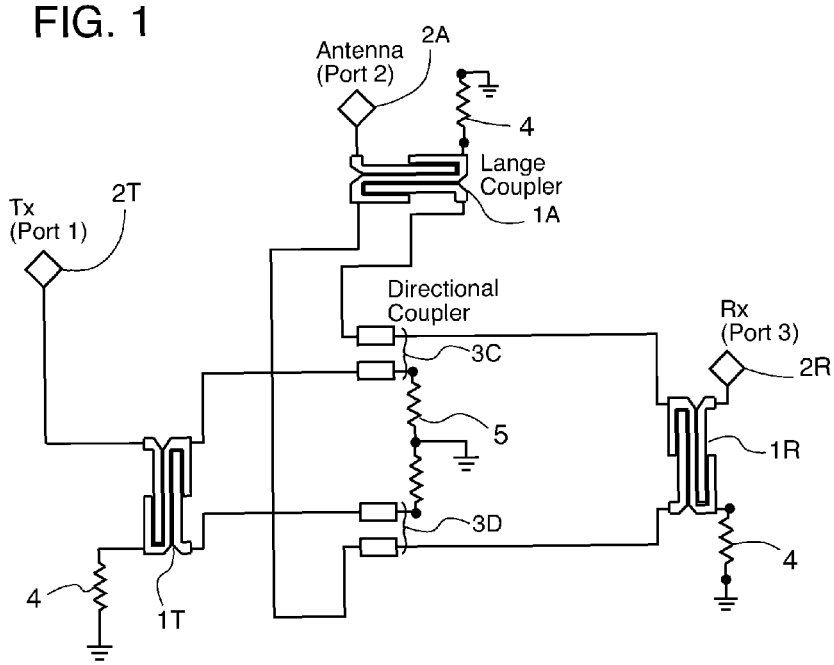
FIG. 1: The building block (passive section) of a proposed quadrature-directive pseudo-circulator (QDQC) that uses both phase combination/cancellation and isolation/directivity techniques.

The basic building block of the device features three quadrature hybrids and two directional couplers that are arranged in the configuration as shown in FIG. 1. The operation principle of the proposed device is as follows. For the transmit mode of STAR operation, the transmit signal is split into quadrature signals by quadrature hybrid, 1T and then coupled to the antenna port through the directional couplers, 3C, 3D, where the coupling factor and directivity of the couplers determines the power amount and direction of signal flow of the transmit signal to the antenna port. The coupled transmit signals leaving the directional couplers for the antenna port are then recombined constructively in phase by the quadrature hybrid, 1A.

Part of the split transmit signals is terminated by the match loads 4, at the isolation ports of the quadrature hybrid. Due to the non-ideal isolation of the coupler, some small portions of the transmit signals will leak to the receive port where they are recombined destructively in phase at the receive port by the quadrature hybrid, 1R. As a result, the isolation between the transmit and receive port is enhanced by the inherited isolation of the directional coupler in additional to the phase cancellation of the three quadrature hybrid structure. The additional isolation also enhances noise figure (NF) performances at the receive port by further suppressing the transmit signals that leak to the receive port for STAR operations; in particular, this enhancement applied to STAR applications in which the transmit signal is firstly amplified by an external power amplifier with certain noise level.

For the receiving mode of STAR operation, the receive signal is split into quadrature signals from the antenna port, 2A, by the quadrature hybrid, 1A, and then coupled to the receive port, 2R, through two directional couplers, 3C and 3D, where the insertion loss of the receive signals are determined by the coupling and directivity of the couplers. The split receive signals leaving the directional couplers are then recombined constructively in phase by the quadrature hybrid, 1R, at the receive port. Both the transmit and receive modes are operated simultaneously. Matching loads 4 are used for each quadrature hybrid.

Figure 1A:
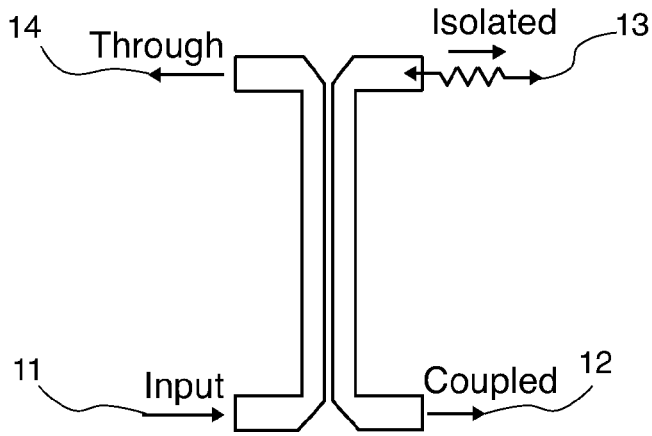
FIG. 1A: is a representation of a typical directional coupler to be used in this application.

FIG. 1A is a graphic representation of the directional couplers indicating the arrangement of the connections. The circuit connections between the directional couplers and the quadrature hybrids of the three-port device are as follows: the INPUT port of the directional couplers, 11, are separately connected to the inner ports of the quadrature hybrid or. Lange coupler at the transmit (TX) port; the COUPLED ports of the directional couplers, 12, are separately connected to the inner ports of the quadrature hybrid or Lange coupler at the Antenna port; the ISOLATED ports of the directional couplers, 13, are separately connected to the inner ports of the quadrature hybrid or Lange coupler at the receive port; the THROUGH ports of the directional couplers, 14, are individually terminated by a matched load, 5. The arrangement of the three quadrature hybrids is in such a way that signal entering the transmit (TX) port will be combined in phase at the Antenna (Ant) port but out of phase at the Receive (Rx) port.

Figure 2:
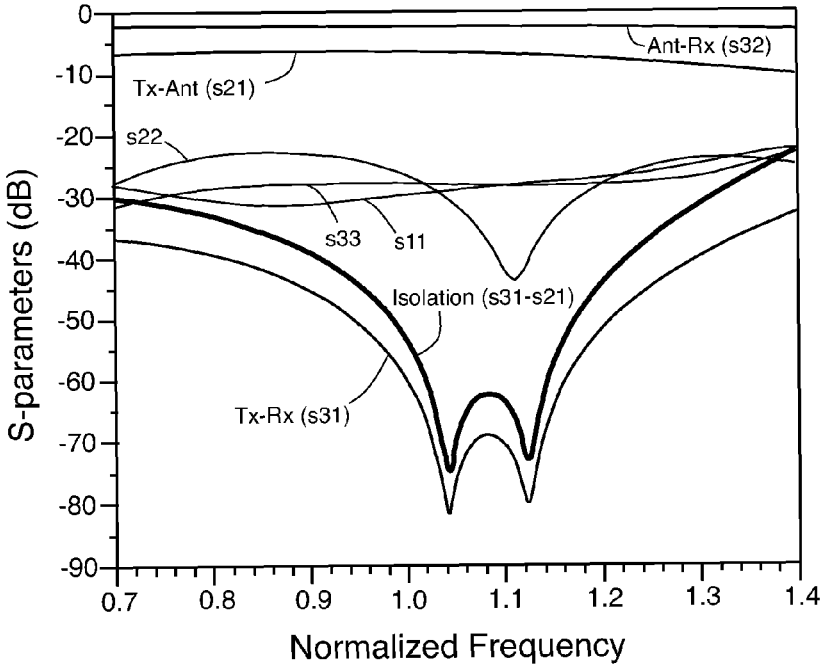
FIG. 2: Performance of the passive section of the QDQC using both phase combination/cancellation and directivity techniques.

FIG. 2 is a graphic representation of the simulation data for the passive section of a QDQC, as shown in FIG. 1, using both phase combination/cancellation and coupling/directivity techniques for STAR operation. The data show an isolation bandwidth of larger than 10% with 60 dB isolation in the X-band using a coupling factor of 6.5 dB for the directional couplers. Data trace 22 shows the isolation of the structure over the same range as data trace 21.

Figure 3:
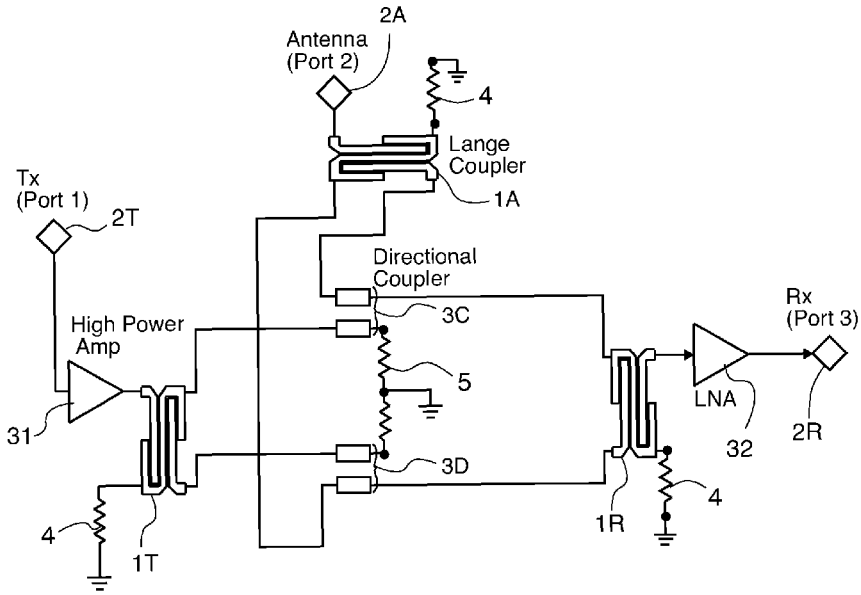
FIG. 3: Schematic of the active QDQC (Version 1) using phase cancellation/combination and directivity techniques. The device architecture uses externally integrated active components to achieve quasi circulating performance.

FIG. 3 is a schematic of an active QDQC (Version 1) using phase cancellation/combination and directivity techniques for STAR operations. The device uses externally integrated active components such as a power amplifier, 31, between the transmit port, 2T and the transmit quadrature hybrid, 1T, and a low noise amplifier between the receive quadrature hybrid, 1R, and the receive port, 2R, to provide quasi circulator operation. The configuration provides a forward transmission of signal from the transmit port to the antenna port, and a forward transmission of signal from the antenna port to the receive port. There is no forward transmission of signal from the receive port to the transmit port and no reverse transmission in all the paths except the transmit to receive path where the signals are cancelled. As a result, the structure provides a quasi circulation operation.

Figure 4:
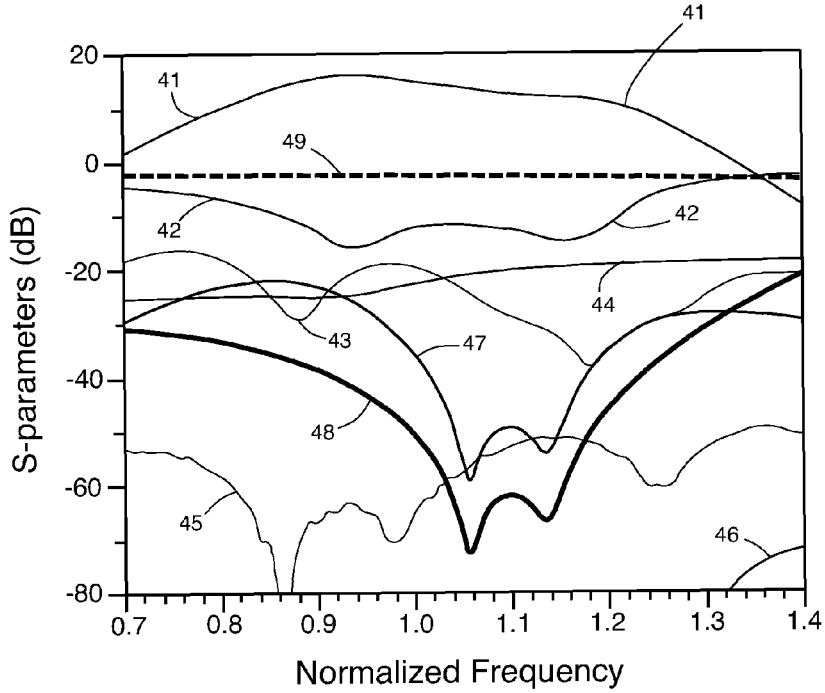
FIG. 4: Performance of the active QDQC using externally integrated PA with measured S-parameters and NF data.

FIG. 4 is a graphic representation of simulation data for the structure in as shown FIG. 3. Data trace 41 shows the gain of the quasi circulator in dB with the power amplifier connected as described in FIG. 3. This is also known as the $S_{21}$ or forward transmission from Tx port to Ant port. Data trace 42 is the reflected signal $S_{11}$ at the transmit port. Data trace 43 is the $S_{22}$ or the reflected signal at the antenna port and data trace 44 is the $S_{33}$ or reflected signal from the receive port. Data trace 45 represents the $S_{12}$ or reverse transmission from the antenna port to the transmit port, data trace 46 is the $S_{13}$ or reverse transmission from the receive port to the transmit port. Data trace 47 is the $S_{31}$ or forward transmission from the Tx port to the Rx port. Data trace 48 is the measurement of isolation which is defined by $S_{31}$-$S_{21}$ or the separation between trace 48 and trace 41. Data trace 49 represents the insertion loss or $S_{32}$ trace between the antenna port and the receive port.

Figure 5:
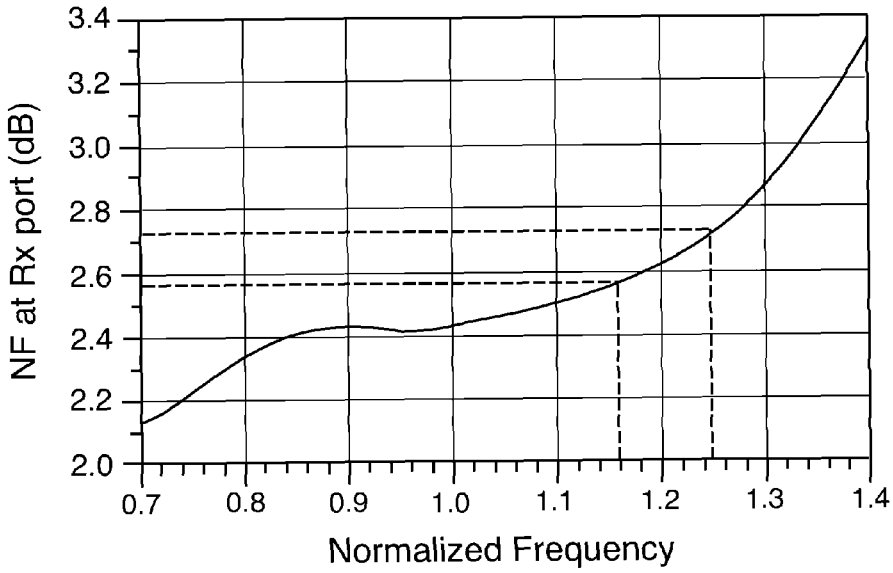
FIG. 5: The simulated NF performance of the QDQC of FIG. 1, that uses externally integrated PA with a behavior model.

FIG. 5 is a graphic display of noise figure performance data for the active QDQC (Version 1) using externally an integrated power amplifiers (PAs). The noise figure at the receive port is displayed on the Y-axis as a function of the normalized frequency range in the X-band on the X-axis. This graph shows a relatively low noise figure for normalized frequency up to 1.4 in the X-band. The noise figure in this normalized frequency range in the X-band is less than 3.4 dB.

Figure 6:
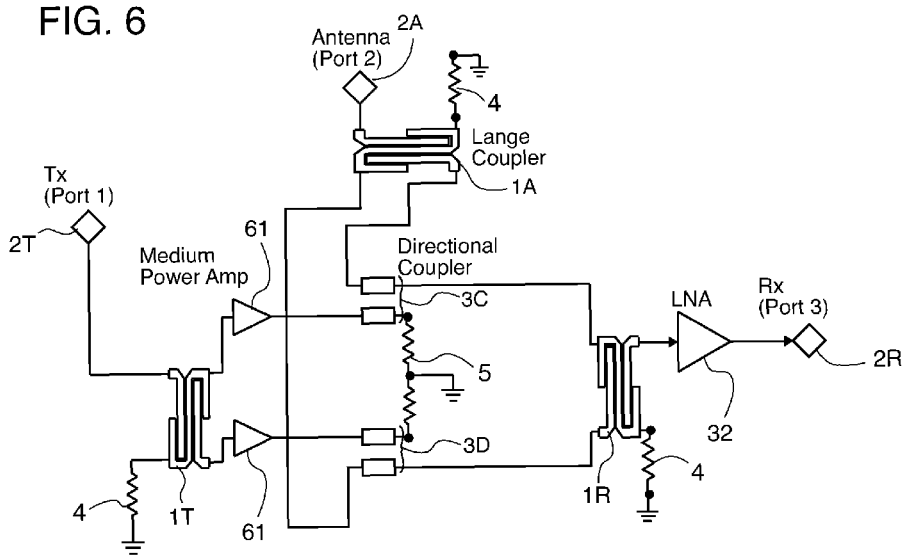
FIG. 6: Schematic of an active QDQC using phase cancellation/combination and directivity techniques. The configuration allows internally integrated power amplifiers in the device. The LNA is placed outside the device structure.

FIG. 6 is a rendition of another embodiment of the device. In this case two medium power amplifiers, 61, are located downstream from the transmission port quadrature hybrid and another low noise-amplifier is located between the receive quadrature hybrid and the receive port. The purpose of this variation is to provide the transmission power with acceptable noise level and to amplify the receiving signal. The circuit can be implemented in MMIC format.

Figure 7:
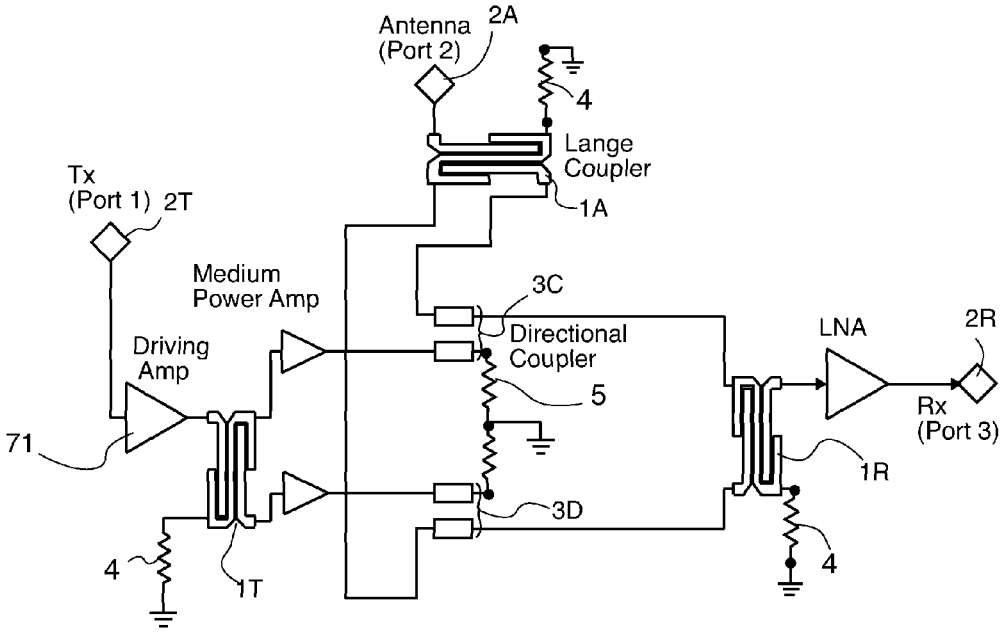
FIG. 7: Schematic of an active QDQC circulator using phase cancellation/combination and directivity techniques. The configuration allows internally integrated MMIC power amplifiers with an external driving amplifier to enable higher power handling capability.

FIG. 7 is a schematic of an active QDQC as in FIG. 6; however this embodiment has an external driving amplifier 71 to share the power loading of the structure, coupled with the internally integrated MMIC power amplifiers to enable higher power handling capability. The driving amplifier has high gain while the medium power amplifiers have lower gain and noise figure. This setting provides a medium noise figure operation at the receive port while providing sufficient transmit power at the antenna port.

Figure 8:
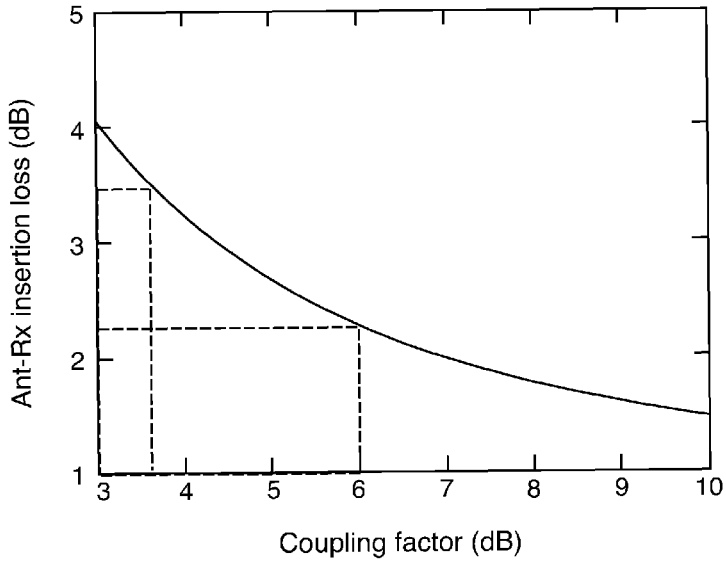
FIG. 8: Preliminary trade-off between the coupling factor and the insertion loss of the Ant-to-Rx path of a QDQC. The amplification for the Tx signal for the active circulator is required to be at least 1 dB above the coupling factor.

FIG. 8 is graphic display of the trade off of insertion loss between the antenna port and the receive port as a function of the coupling factor of the directional coupler in dB.

Figure 9:
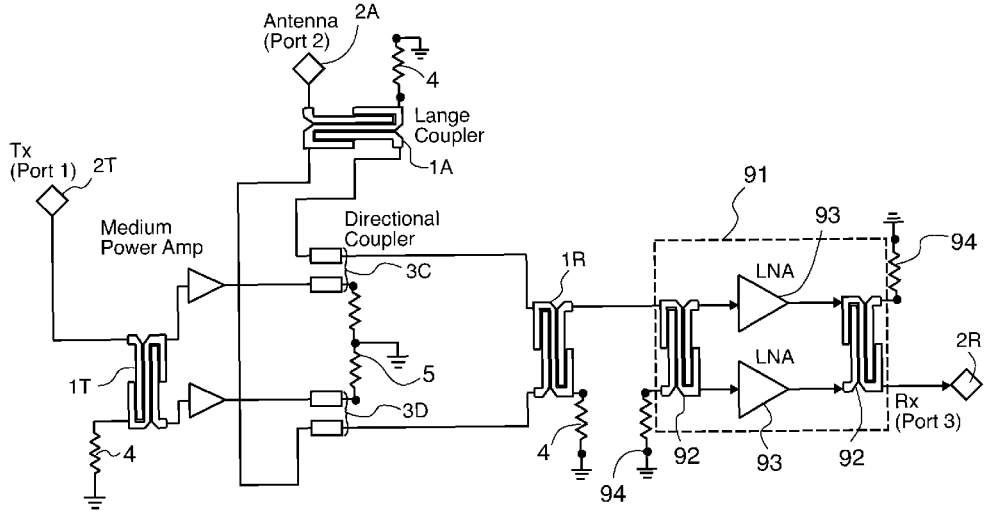
FIG. 9: Schematic an active QDQC that employs the phase combination/cancellation and coupling directivity techniques. This approach includes a balanced LNA structure to further isolate reflection from the LNA back to the antenna due to impedance mismatch.

FIG. 9 is a schematic of a QDQC (version 4) employing the phase combination/cancellation and coupling directivity techniques. This configuration includes a balanced structure, 91, to provide quasi circulation operation and further isolate reflections from said receive port by two methods. The first method is through the use of two low noise amplifiers 93, which are a unilateral devices directing most of the signal to the receive port and isolating backward transmission. The second method is the use of two balanced Lange or quadrature structures 92, with matching load circuits, 94, to suppress mismatched reflection at the input of the LNA back to the antenna port by loading the reflection signals to the isolation termination, 94, of the hinge coupler, 92.

What is claimed is:

1. A circulator capable of simultaneous transmit and receive operations, high frequency, enhanced high isolation, broadband performance and noise figure suppression comprising:

an antenna port;

a transmission port;

a receiving port;

three quadrature hybrids, one for each said port;

two directional couplers;

wherein each port is connected to a quadrature hybrid for splitting an input signal into two output components, the said output components have a ninety degrees relative phase difference to each other;

each of said quadrature hybrid in addition to the connection to the above mentioned ports has at least two output connections each of which are connected to a separate directional couplers and if a fourth connection, said fourth connection is attached to a matching load circuit;

said directional couplers have four ports: an INPUT port, a COUPLED port, a THROUGH port and an ISOLATED port;

the INPUT ports of said directional couplers are connected to the inner ports of the quadrature hybrid at said transmit port;

the COUPLED ports of said directional coupler are connected to the inner ports of the quadrature hybrid at said antenna port;

the ISOLATED ports of said direction coupler are connected to the inner ports of the quadrature hybrid at said receive port;

the THROUGH ports of said directional coupler are individually terminated by a to matching load;

the inner ports of the quadrature hybrid at the transmit (Tx) port are the ports other than the ports that are connected to the Tx port and the matched load;

the inner ports of the quadrature hybrid at the antenna (Ant) port are the ports other than the ports that are connected to the antenna port and the matched load;

the inner ports of the quadrature hybrids at the receive (Rx) port are the ports other than the ports that are connected to the receive port and the matched load;

this arrangement of circuits allows the portion of the coupled quadrature signals from the transmit port to be mainly directed towards the antenna quadrature hybrid and be recombined in phase at the antenna port, the residual coupled quadrature signals that are passed through said directional couplers enter the receive quadrature hybrid and are phase cancelled;

said arrangement simultaneously allows the receive signal entering the antenna port and proceeding to the antenna quadrature hybrid to enter the receive quadrature hybrid and to be combined in phase at the receive port.

2. A circulator capable of simultaneous transmit and receive operations, high frequency, enhanced high isolation, broad band performance and noise figure suppression as described in claim 1 wherein a quadrature structure is substituted for said quadrature hybrid, said quadrature structure may be a Lange coupler.

3. A circulator capable of simultaneous transmit and receive operations, high frequency, enhanced high isolation, broad band performance and noise figure suppression as described in claim 1 wherein an internally integrated power amplifier is placed between the transmit port and the transmit quadrature structure to increase the signal strength and a low noise amplifier is placed between the receive quadrature structure and the receive port to increase the signal strength and reduce reverse transmission of the receive signal.

4. A circulator capable of simultaneous transmit and receive operations, high frequency, enhanced high isolation, broad band performance and noise figure suppression as described in claim 1 wherein two internal power amplifiers are placed between the transmit quadrature structure and the directional couplers to enable MMIC integration for size reduction with signal amplification capability.

5. A circulator capable of simultaneous transmit and receive operations, high frequency, enhanced high isolation, broad band performance and noise figure suppression as described in claim 4 further comprising an amplifier inserted to the circuitry after the transmit port but before the quadrature structure to provide driving power to the internal power amplifier with lower gain and lower noise figure to enable acceptable noise figure performance at the receive port.

6. A circulator capable of simultaneous transmit and receive operations, high frequency, enhanced high isolation, broad band performance and noise figure suppression as described in claim 4 further comprising a balance structure including additional quadrature structures after the receive port quadrature structure that leads to two low noise amplifiers to a final quadrature structure followed by the receive port; wherein the purpose of this balance structure is to further isolate reflection from the low noise amplifiers back to the antenna port due to impedance mismatch at the input of the low noise amplifiers.

* * * * *